US006415622B2

(12) United States Patent
Kim et al.

(10) Patent No.: US 6,415,622 B2
(45) Date of Patent: Jul. 9, 2002

(54) AIR OUTLET OPENING APPARATUS FOR AIR CONDITIONERS

(75) Inventors: Jong-Whal Kim, Suwon; Do-Yeon Kim, Uiwang, both of (KR)

(73) Assignee: SamSung Electronics, Co., Ltd., Suwon (KR)

( * ) Notice: Subject to any disclaimer, the term of this patent is extended or adjusted under 35 U.S.C. 154(b) by 0 days.

(21) Appl. No.: 09/804,138

(22) Filed: Mar. 13, 2001

(30) Foreign Application Priority Data

Jun. 12, 2000 (KR) ..... 2000-32179
Jun. 12, 2000 (KR) ..... 2000-32180

(51) Int. Cl.[7] ..... F25D 17/04

(52) U.S. Cl. ..... 62/409; 62/408; 62/419; 62/426

(58) Field of Search ..... 62/408, 409, 419, 62/426

(56) References Cited

U.S. PATENT DOCUMENTS 4,412,480 A * 11/1983 Cardiff ..... 98/40
4,696,340 A * 9/1987 Nagao et al. ..... 165/58
4,774,030 A * 9/1988 Kinkel et al. ..... 261/29
5,769,709 A * 6/1998 Kim ..... 454/318
5,769,710 A * 6/1998 Kim ..... 454/324
6,012,297 A * 1/2000 Ichishi et al. ..... 62/179
6,189,801 B1 * 2/2001 Klingler et al. ..... 237/12.3

FOREIGN PATENT DOCUMENTS

JP 10-047746 2/1998

* cited by examiner

*Primary Examiner*—William C. Doerrler
*Assistant Examiner*—Mark Shulman
(74) *Attorney, Agent, or Firm*—Robert E. Bushnell, Esq.

(57) ABSTRACT

An air outlet opening apparatus for air conditioners is provided. The air outlet opening apparatus includes a shutter for selectively opening and closing the air outlet formed on an air conditioner body. A pair of support plates is mounted beside the shutter to guide the elevation and lowering of the shutter. The air outlet opening apparatus further includes elevation means for selectively elevating and lowering the shutter. The elevation means includes a pair of elevation members positioned to be slid on the support plates, a drive motor for generating power to move the elevation members, and power transmission means for converting the rotating movement of the drive motor to the simultaneous linear movements of the elevation members.

13 Claims, 12 Drawing Sheets

AIR OUTLET OPENING APPARATUS FOR AIR CONDITIONERS

CLAIM OF PRIORITY

This application makes reference to, incorporates the same herein, and claims all benefits accruing under 35 U.S.C. §119 from my applications entitled *OPENING AND CLOSING APPARATUS FOR AIR DISCHARGE PORT OF AIR CONDITIONER* filed with the Korean Industrial Property Office on Jun. 12, 2000 and there duly assigned Ser. Nos. 2000/32179 and 2000/32180.

BACKGROUND OF THE INVENTION

1. Field of the Invention

The present invention relates generally to air outlet opening apparatus for air conditioners, and more particularly to an air outlet opening apparatus for air conditioners, which is capable of being smoothly operated without laterally tilting its shutter.

2. Description of the Prior Art

In the housing of the air conditioner body of a general air conditioner are formed an air inlet for sucking indoor air and an air outlet for exhausting air-conditioned air into an indoor space. A heat exchanger for exchanging heat with sucked air and a fan for blowing air from the heat exchanger to the air outlet are mounted in the air conditioner body of the air conditioner. Recently, in order to prevent dust or impurities from entering the air conditioner body through the air outlet, an air outlet opening apparatus for selectively opening and closing the air outlet is generally provided in the air conditioner body of the air conditioner.

As illustrated in FIG. 1, a conventional air outlet opening apparatus for air conditioners includes a shutter 3 having a size sufficient to selectively open and close the air outlet 2 formed in the front panel 1 of an air conditioner body, a pair of support plates for guiding the movement of the shutter 3 as well as supporting the shutter 3, and elevation means for selectively elevating and lowering the shutter.

An upper guide groove 6*a* and a lower guide groove 6*b* are formed on the inner side surface of each of the support plates 4*a* and 4*b* situated beside the air outlet 2. Two guide pins 7*a* and 7*b* are formed on each of the outer side surfaces of the shutter 3 to guide the movement of the shutter 3 while being fitted into the upper and lower guide grooves 6*a* and 6*b*.

The elevation means includes an elevation member 5 provided with a rack gear portion 5*a*, a pinion gear 8 engaged with the rack gear portion 5*a* of the elevation member 5, and a drive motor 9 for driving the pinion gear 8. The elevation member 5 is attached to the central portion of the rear surface of the shutter 3. The drive motor 9 assembled with the pinion gear 8 is secured to the rear surface of the front panel 1. In this case, the pinion gear 8 is engaged with the rack gear portion 5*a* of the elevation member 5.

In the conventional air outlet opening apparatus for air conditioners, as the pinion gear 8 is rotated by the operation of the drive motor 9, the elevation member 5 is elevated. Accordingly, the shutter 3 secured to the elevation member 5 is elevated while being guided by the guide grooves 6*a* and 6*b* of the support plates 4*a* and 4*b*, thereby selectively opening and closing the air outlet 2 of the front panel 1.

In the conventional air outlet opening apparatus, a single elevation member 5 is secured to the center portion of the shutter 3, so the shutter 3 is laterally tilted by the vibration of the apparatus. As a result, the shutter is not elevated smoothly and, consequently, the guide grooves 6*a* and 6*b* and the guide pins 7*a* and 7*b* are worn out.

SUMMARY OF THE INVENTION

Accordingly, the present invention has been made keeping in mind the above problems occurring in the prior art, and an object of the present invention is to provide an air outlet opening apparatus for air conditioners, which is capable of selectively elevating and lowering its shutter at two horizontally spaced positions, thereby smoothly performing the elevation and lowering of its shutter and the opening and closing of the air outlet.

In order to accomplish the above object, the present invention provides an air outlet opening apparatus for air conditioners, including: a shutter for selectively opening and closing the air outlet formed on an air conditioner body; a pair of support plates mounted beside the shutter to guide the elevation and lowering of the shutter; and elevation means for selectively elevating and lowering the shutter; wherein the elevation means includes a pair of elevation members positioned to be slid on the support plates, a drive motor for generating power to move the elevation members, and power transmission means for converting the rotating movement of the drive motor to the simultaneous linear movements of the elevation members.

The power transmission means can include two rack gear portions formed on the elevation members, a pair of pinion gears, one of which is engaged with the drive motor, engaged with the rack gear portions, and a common shaft connecting the pinion gears.

The elevation means can further include guide grooves formed longitudinally on the support plates and two pairs of support pins each mounted on both sides of the shutter while being spaced apart from each other and inserted into the guide grooves while passing through the elevation members.

The guide grooves can include first and second guide grooves which partially overlap each other to communicate with each other, and the support pins can include first and second support pins which are inserted into the first and second guide grooves, respectively.

The guide grooves may be comprised of first and second guide grooves which partially overlap each other to communicate with each other, and the support pins may be comprised of first and second support pins which are inserted into the first and second guide grooves, respectively.

The first and second guide grooves may be formed to have different depths, and the first and second support pins may be formed to have lengths corresponding to the depths of the first and second guide grooves.

The first guide groove may be formed to have a relatively narrow width and a relatively deep depth, the second guide groove may be formed to have a relatively wide width and a relatively shallow depth, and the first and second support pins may be formed to have widths and lengths corresponding to the widths and depths of the first and second guide grooves.

The first and second guide grooves may each have a vertical groove portion that is connected to a horizontal groove portion extending toward the air outlet at its upper end to guide the first and second guide pins, and the elevation members may be each provided with upper and lower inclined slots to guide the support pins through the horizontal groove portions when the support pins reach the horizontal groove portions.

The upper inclined slot may have a vertical extension at its lower end and the lower inclined slot may be formed to be longer than the upper inclined slot, and the first support pin inserted into the upper inclined slot may be situated behind the second support pin inserted into the lower inclined slot in the anteroposterior direction of the shutter.

The common shaft may have a polygonal sectional shape to minimize its twisting.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENTS

Figure 1:
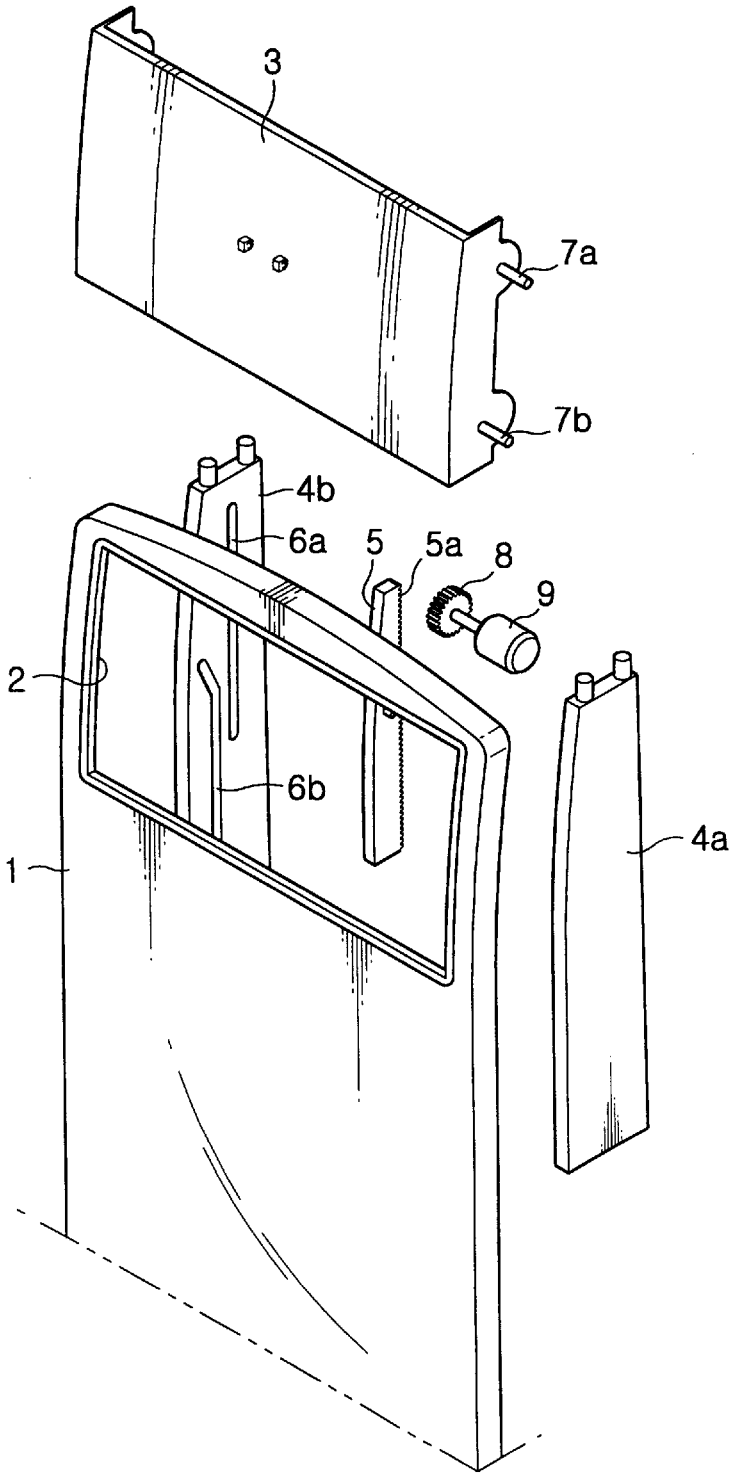
FIG. 1 (PRIOR ART)
FIG. 1 is an exploded perspective view showing a conventional air outlet opening apparatus for air conditioners.

Reference now should be made to the drawings, in which the same reference numerals are used throughout the different drawings to designate the same or similar components.

Figure 2:
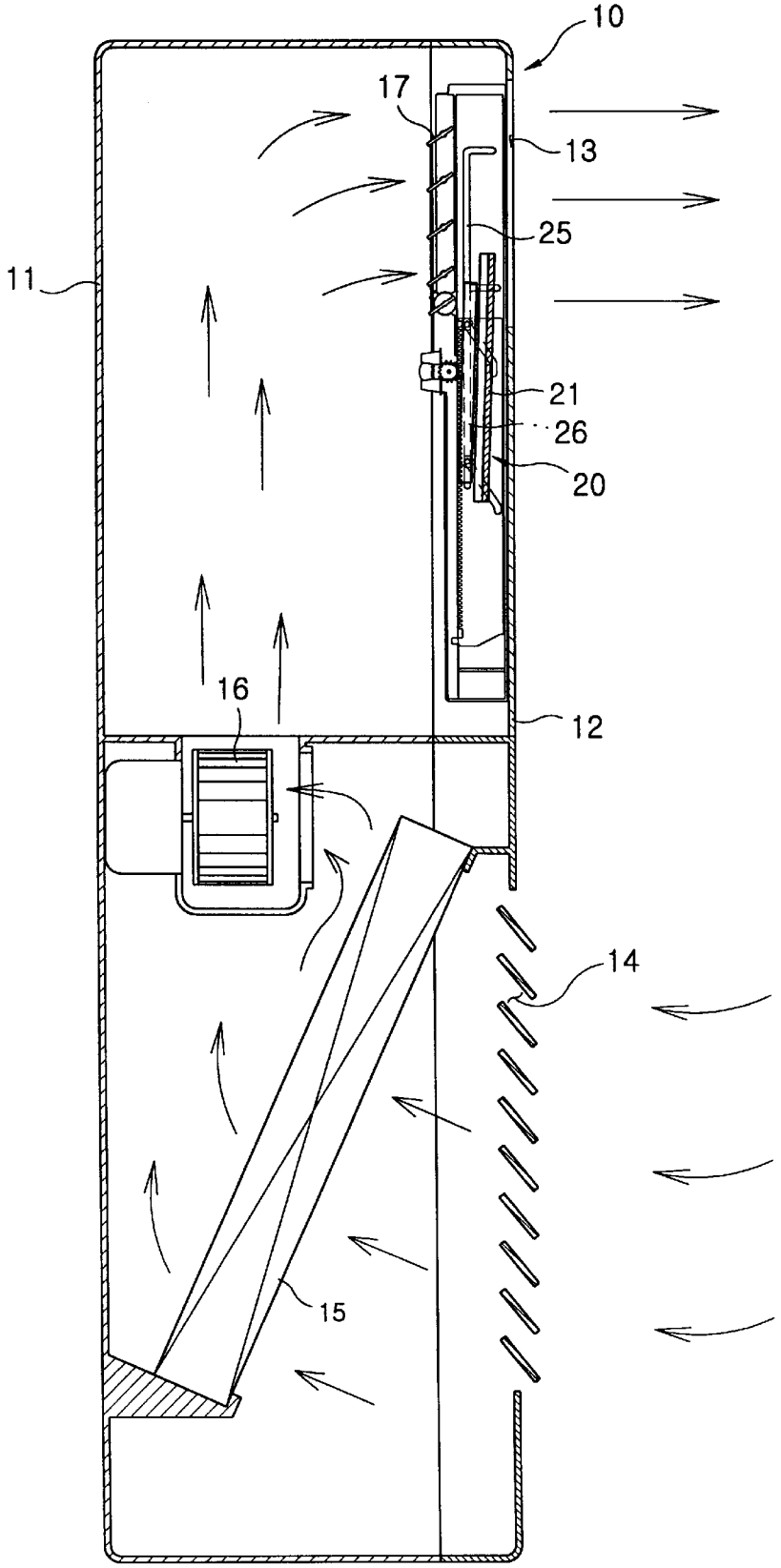
FIG. 2 is a cross section showing the structure of an air conditioner body in accordance with an embodiment of the present invention.

As illustrated in FIG. 2, an air conditioner of the present invention includes an air conditioner body 10 that includes a box-shaped casing 11 and a front panel 12 for covering the open front of the casing 11. A heat exchanger 15 for performing heat exchange and a fan 16 for blowing air are mounted in the interior of the air conditioner body 10. An air outlet 13 for exhausting air-conditioned air to an indoor space and an air inlet 14 for sucking indoor air into the interior of the air conditioner body 10 are formed in the upper and lower portions of the front panel 12, respectively.

A plurality of wind direction adjusting blades 17 for adjusting the direction of exhausted air are situated at positions that are inwardly spaced apart from the air outlet 13. An air outlet opening apparatus 20 of the present invention is mounted in front of the wind direction adjusting blades 17. The shutter 21 of the air outlet opening apparatus 20 selectively opens and closes the air outlet 13 while being selectively elevated and lowered along guide grooves 25 and 26 provided beside the air outlet 13.

The air outlet opening apparatus of the present invention is characterized in that the shutter 21 can be elevated and lowered by applying force to the shutter 21 in two positions so as to allow the shutter 21 to be smoothly elevated and lowered.

Figure 3:
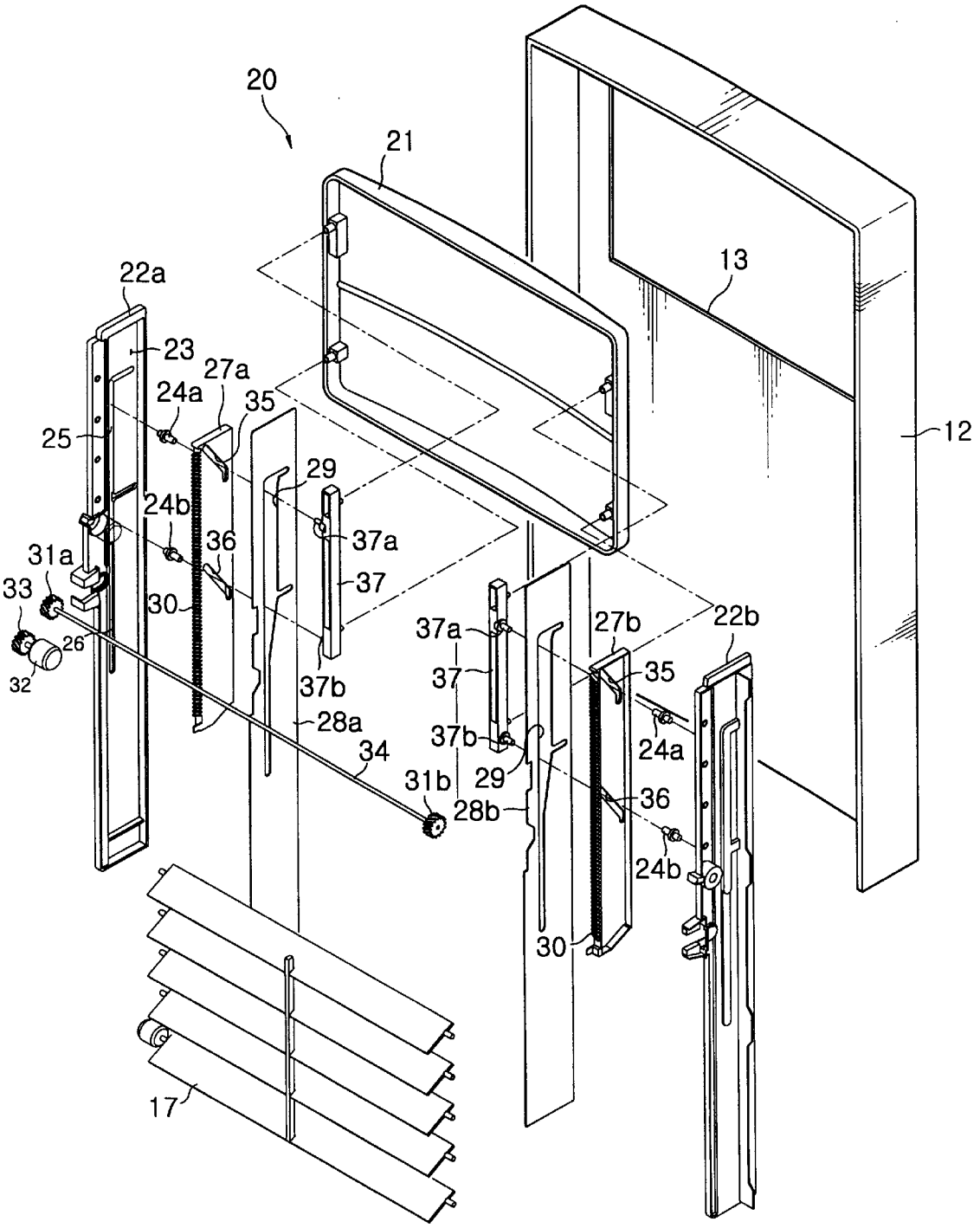
FIG. 3 is an exploded perspective view showing the air outlet opening apparatus of the embodiment of FIG. 2.
Figure 4:
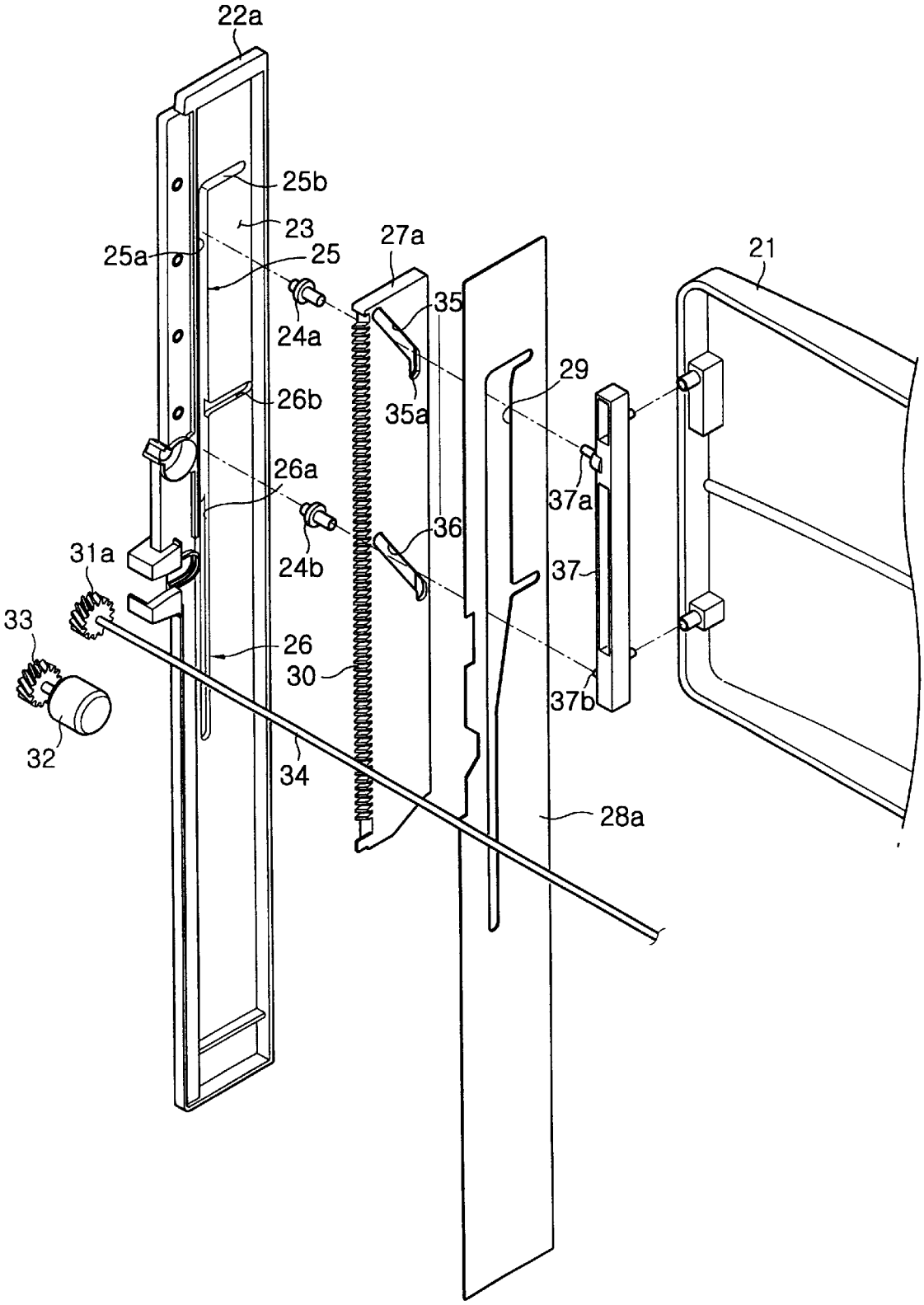
FIG. 4 is a detailed view showing a section of FIG. 3.

As shown in FIGS. 3 and 4, a pair of support plates 22*a* and 22*b* are longitudinally disposed along both sides of the inner surface of a front panel 12 beside the air outlet 13 formed in the front panel 12 to support and guide the movement of the shutter 21. A depression 23 is longitudinally formed on the inner surface of each of the support plates 22*a* and 22*b*, and two guide grooves 25 and 26 are formed on the depression 23 to guide support pins 24*a* and 24*b* that are connected to one side of the shutter 21.

Two elevation members 27*a* and 27*b* are each positioned in the depression 23 so as to be selectively elevated and lowered to selectively elevate and lower the shutter 21. Two cover plates 28*a* and 28*b* are attached to the support plates 22*a* and 22*b* to support the shutter 21. A guide cutout 29 is formed in each of the cover plates 28*a* and 28*b* to correspond to one of the guide grooves 25*a* and 26*a*.

A rack gear portion 30 is formed on one side of each of the elevation members 27*a* and 27*b*. Two pinion gears 31*a* and 31*b* are situated to be engaged with the rack gear portions 30 of the elevation members 27*a* and 27*b*, respectively. The two pinion gears 31*a* and 31*b* are connected by a horizontal common shaft 34 to be rotated at the same time. The pinion gear 31 a is engaged with the gear 33 of a drive motor 32. Accordingly, the air outlet opening apparatus of the present invention is constructed so that the pinion gears 31*a* and 31*b* are rotated by the operation of the drive motor 32 and the elevation members 27*a* and 27*b* are elevated or lowered by the rotation of the pinion gears 31*a*and 31*b*. That is, the two pinion gears 31*a* and 31*b* are simultaneously rotated by the operation of the drive motor 32, thereby allowing the two elevation members 27*a* and 27*b* to be elevated or lowered at the same time. In this case, the common shaft 34 of the pinion gears 31*a* and 31*b* preferably has a polygonal sectional shape so as to minimize its twisting.

Two pairs of support pins are each situated beside the shutter 21. Each pair of support pins includes an upper support pin 24*a* and a lower support pin 24*b*, and the upper and lower support pins 24*a* and 24*b* are upwardly spaced apart from each other. Each of the support pins 24*a* and 24*b* passes through one of the cover plates 28*a* and 28*b* and one of the elevation members 27*a* and 27*b*, and is inserted into one of the guide grooves 25 and 26 of the support plates 22*a* and 22*b*. Accordingly, while the elevation members 27*a* and 27*b* are elevated or lowered, the support pins 24*a* and 24*b* are moved along the guide grooves 25 and 26 formed in the support plates 22*a* and 22*b*. That is, the elevation members 27*a* and 27*b* force the support pins 24*a* and 24*b* to be elevated or lowered.

Figure 8:
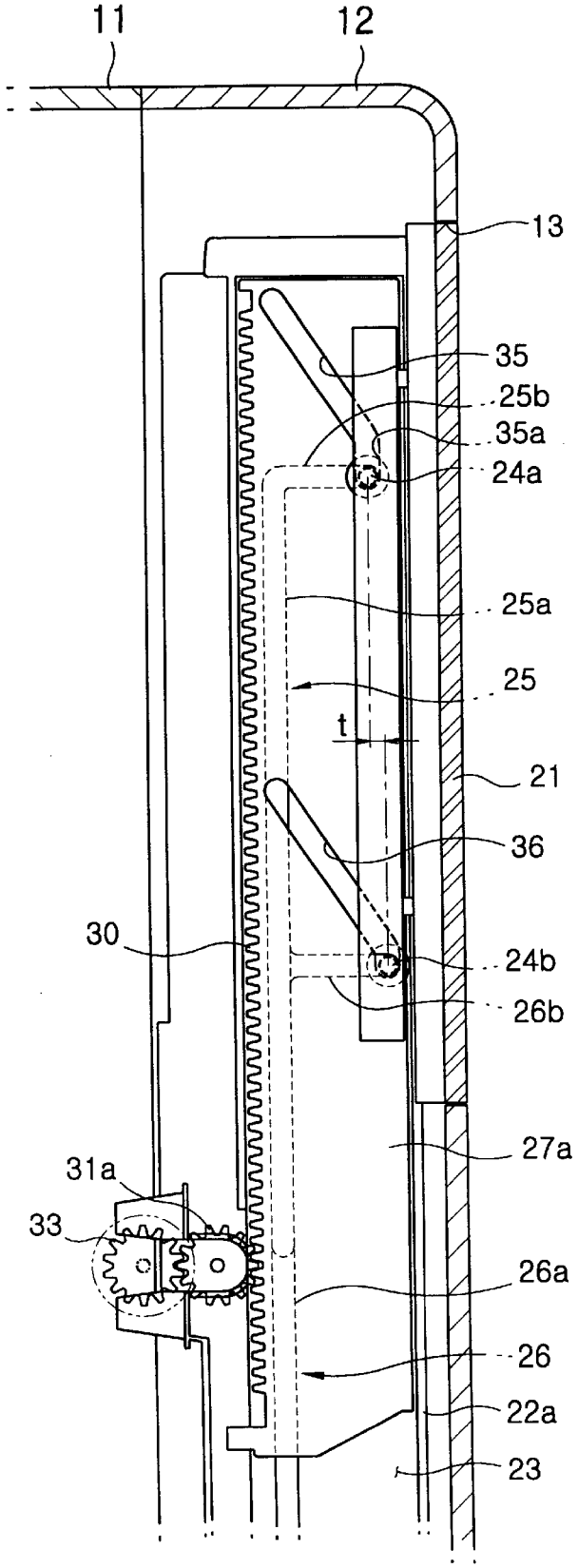
FIG. 8 is a detailed view showing the important section of FIG. 7.
Figure 9:
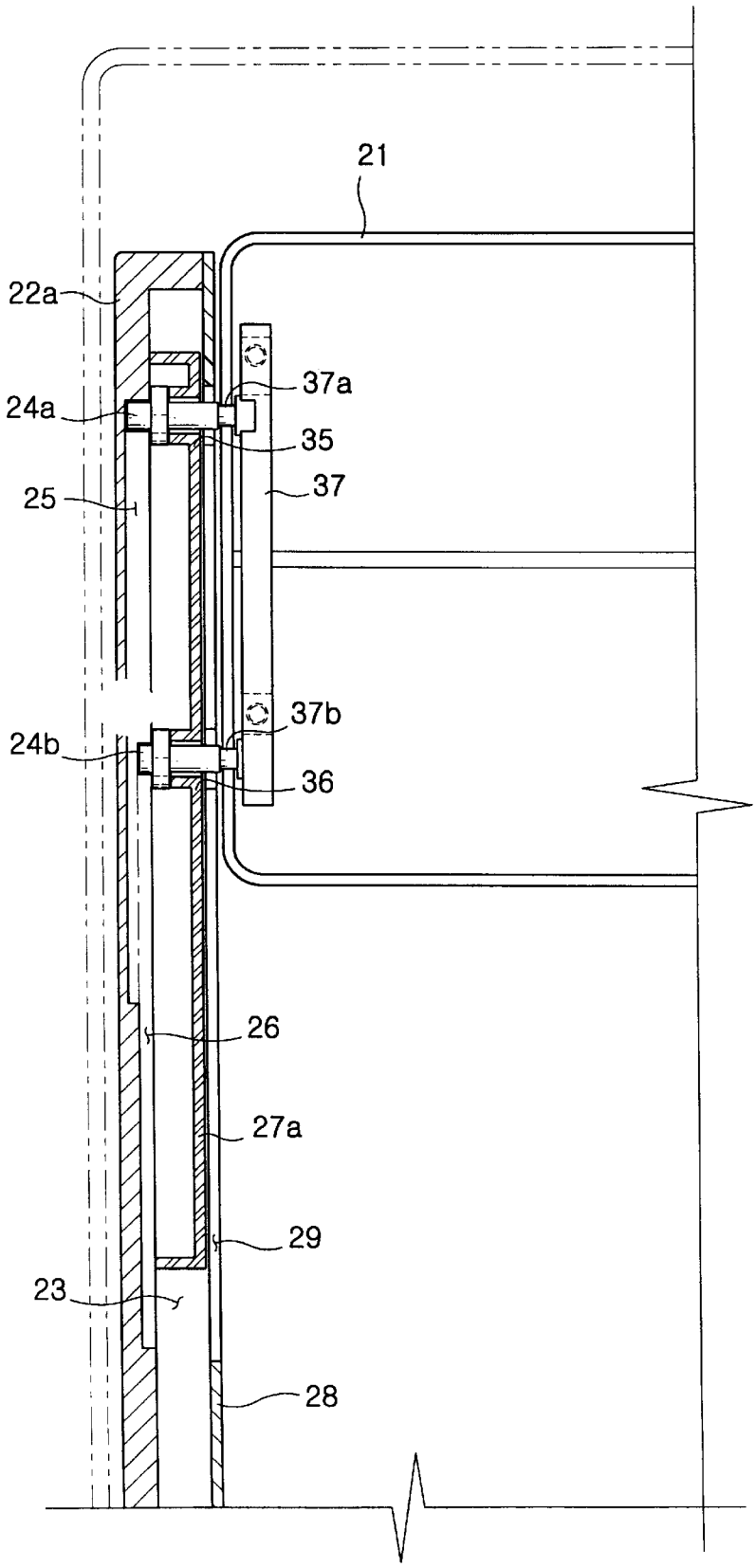
FIG. 9 is a cross section taken along line A–A' of FIG. 7.

As shown in FIGS. 8 and 9, each pair of guide grooves formed on each of the support plates 22*a* and 22*b* includes a first guide groove 25 and a second guide groove 26. The first guide groove 25 consists of a vertical groove portion 25*a* longitudinally extended on one of the support plates 22*a* and 22*b* and a horizontal groove portion 25*b* transversely extended from the upper end of the vertical groove portion 25*a* on one of the support plates 22*a* and 22*b*; while the second guide groove 26 consists of a vertical groove portion 26*a* longitudinally extended on one of the support plates 22*a* and 22*b* and a horizontal groove portion 26*b* transversely extended from the upper end of the vertical groove portion 26*a* on one of the support plates 22*a* and 22*b*. The vertical groove portions 25*a* and 26*a* serve to guide the elevation and lowering of the first and second support pins 24*a* and 24*b*, respectively. The horizontal groove portions 25*b* and 26*b* serve to guide the first and second support pins 24*a* and 24*b* so that the shutter 21 is somewhat projected trough the air outlet 13 by allowing the first and second support pins 24*a* and 24*b* to move forward when the first and second support pins 24*a* and 24*b* reach the upper ends of the vertical groove portions 25*a* and 26*a*, respectively.

The lower end of the first guide groove 25 and the upper end of the vertical groove portion of the second guide groove 26 coincide with each other, thus causing the first and second guide grooves 25 and 26 to be connected to each other. However, the first support pin 24*a* is moved along only the first guide groove 25 and the second support pin 24*b* is moved along only the second guide groove 26, so the support pins 24*a* and 24*b* are moved smoothly. To this end, as shown in FIG. 9, the first and second guide grooves 25 and 26 are formed to have different depths and the first and second support pins 24*a* and 24*b* are formed to have different lengths. In more detail, the first guide groove 25 is formed to have a relatively deep depth, whereas the second guide groove 26 is formed to have a relatively shallow depth. The portion of the first support pin 24*a* inserted into the first guide groove 25 is formed to have a relatively long length, while the portion of the second support pin 24*b* inserted into the second guide groove 26 is formed to have a relatively short length.

Figure 10:
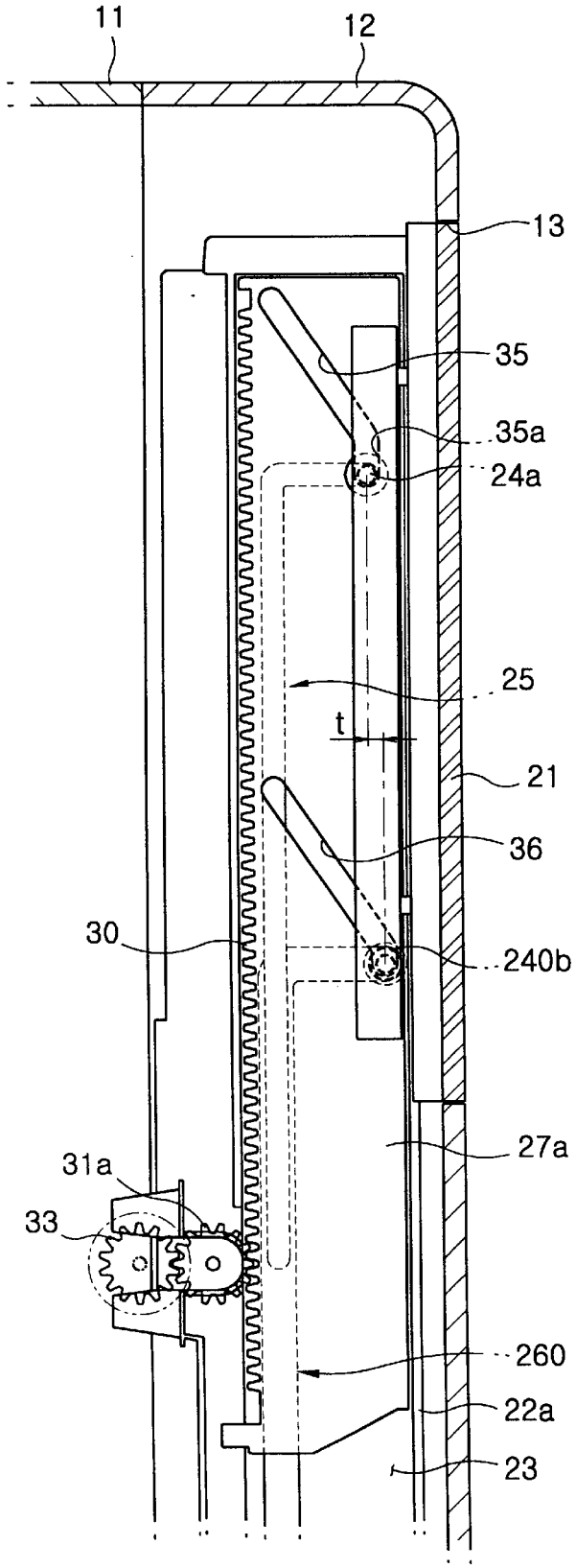
FIG. 10 is a cross section showing guide grooves and support pins in accordance with another embodiment of the present invention.

FIG. 10 is a cross section showing guide grooves and support pins in accordance with another embodiment of the present invention. In this embodiment, the depths of the first and second guide grooves 25 and 260 are different, the lengths of the first and second support pins 24*a* and 240*b* are different, the width of the second guide groove 260 is larger than that of the first guide groove 25, and the outer diameter of the second support pin 240*b* inserted into the second guide groove 260 is larger than that of the first support pin 24*a* to correspond to the width of the second guide groove 260. This construction allows the support pins 25 and 260 to be smoothly elevated or lowered, and prevents the support pins 25 and 260 from being wrongly assembled.

Referring to FIGS. 4 and 8, an upper inclined slot 35 and a lower inclined slot 36 are formed on each of the elevation members 27*a* and 27*b* at positions where the support pins 24*a* and 24*b* pass through the elevation member 27*a* or 27*b*. The inclined slots 35 and 36 serve to cause the support pins 24*a* and 24*b* to be moved along the horizontal groove portions 25*b* and 26*b* when the support pins 24*a* and 24*b* are upwardly moved along the vertical groove portions 25*a* and 26*a* and reach the horizontal groove portions 25*b* and 26*b* by the elevation of the elevation members 27*a* and 27*b*.

In this case, the upper inclined slot 35 has a vertical extension 35*a* that is downwardly extended from its lower end, and the lower inclined slot 36 is formed to have a length larger than that of the upper inclined slot 35. Two connecting bars 37 are attached to both side ends of the shutter 21. Two projections 37*a* and 37*b* are formed on each of the connecting bars 37 in upper and lower positions to hold the first and second support pins 24*a* and 24*b*. The upper projection 37*a* connected to the first support pin 24*a* is situated in a rear position, while the lower projection 37*b* connected to the second support pin 24*b* is situated in a front position. The horizontal groove portion 25*b* of the first guide groove 25 is formed to be shorter than that of the horizontal groove portion 26*b* of the second guide groove 26.

In this construction, the first support pin 24*a* is situated behind the second support pin 24*b* on the side of the shutter 21, so the first and second support pins 24*a* and 24*b* are engaged with the upper and lower inclined grooves 35 and 36 without hindrance. Additionally, this construction allows the shutter 21 to be closed, in such a way that the front surface of the shutter 21 is situated in the same plane that the front surface of the front panel 12 forms and a position difference t is maintained between the first and second support pins 24*a* and 24*b*, when the shutter 21 is completely closed by the elevation of the elevation members 27*a* and 27*b*. When the shutter 21 is opened by the lowering of the elevation members 27*a* and 27*b*, the shutter 21 is first opened on its lower portion and the shutter 21 is forwardly inclined, thereby allowing the lowering of the shutter 21 to be performed smoothly.

Figure 11:
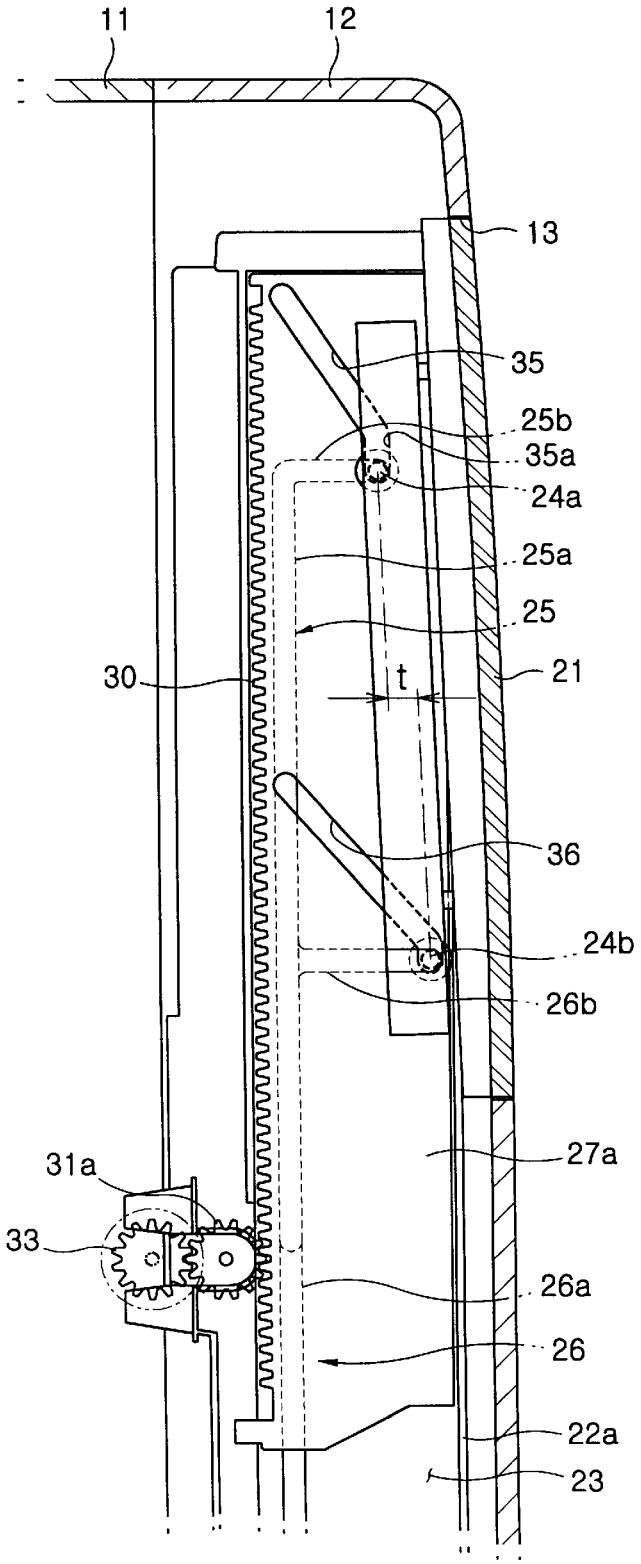
FIGS. 11 and 12 are cross sections showing another air conditioner body in accordance with another embodiment of the present invention.
Figure 12:
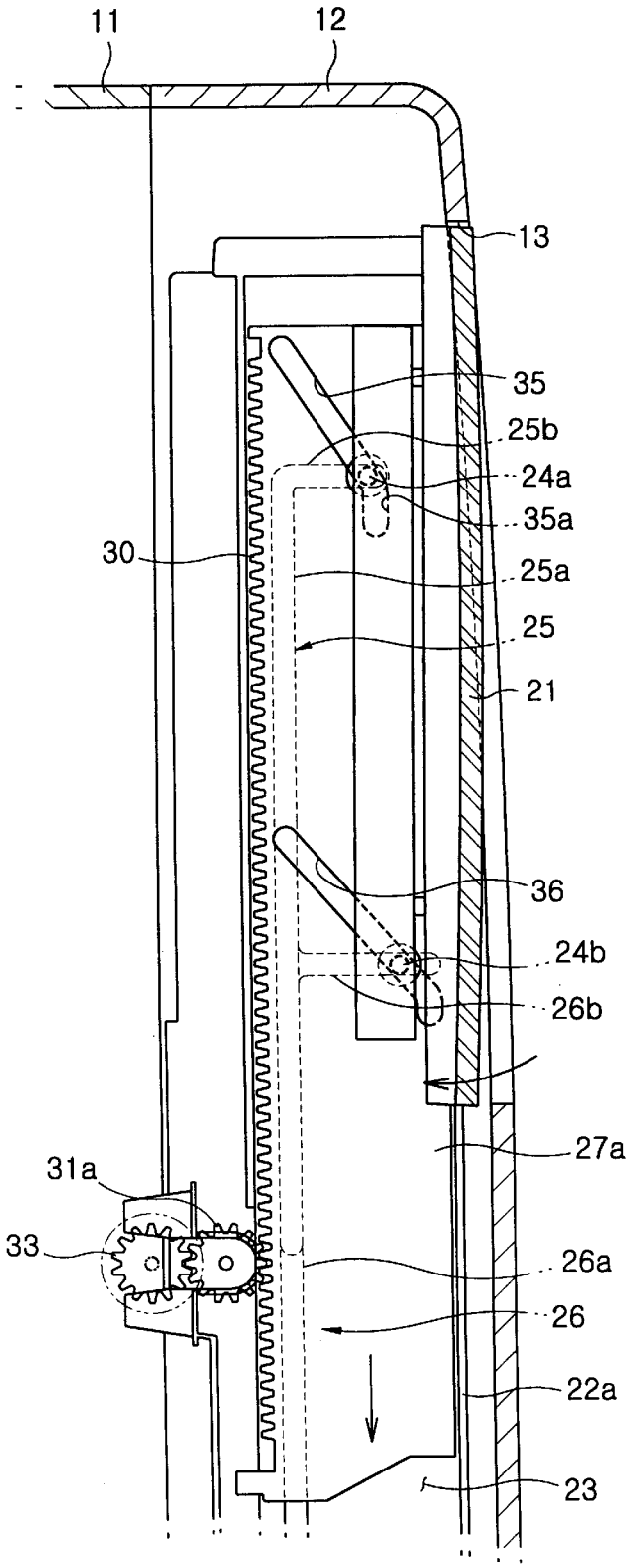

In particular, this construction, as illustrated in FIG. 11, causes the opening and closing of the shutter 21 to be performed smoothly when the front panel 12 of the air conditioner body 10 is curved. In this case, when the horizontal groove portion 26*b* of each second guide groove 26 and the lower inclined slot 36 of each elevation member 27*a*, 27*b* is formed to have a length greater than usual and the position difference t between the first and second support pins 24*a* and 24*b* is enlarged, the shutter 21 is closed with its front surface situated in the same plane as the front surface of the front panel 12 forms. Additionally, as shown in FIG. 12, when the shutter 21 is opened by the lowering of the elevation members 27*a* and 27*b*, the lower portion of the shutter 21 is first opened, thus allowing the lowering of the shutter 21 to be smoothly performed.

In addition, an interval between the upper horizontal groove portion 25*b* and the lower horizontal groove portion 26*b* should coincide with an interval between the first and second support pins 24*a* and 24*b* in order to cause the above operations to be smoothly performed.

The operation of the air outlet opening apparatus of the present invention is described, hereinafter.

Figure 5:
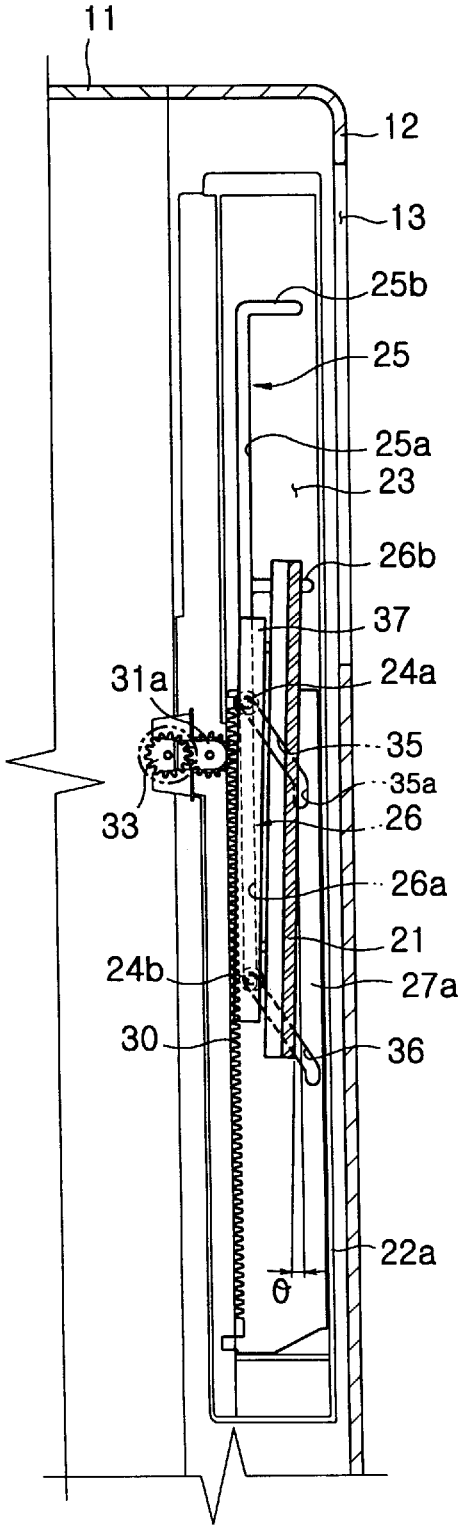
FIGS. 5, 6 and 7 are cross sections showing the operation of the air outlet opening apparatus of the first embodiment of FIGS. 2 and 3.

As shown in FIG. 5, when the air outlet 13 of the air conditioner body 10 is opened, the elevation member 27*a* is situated on the lower portion of the support plate 22*a*, and the support pins 24*a* and 24*b* are also situated on the lower portion of the support plate 22*a* while being present in the vertical groove portions 25*a* and 26*a* of the first and second guide grooves 25 and 26, respectively. The support pins 24*a* and 24*b* are prevented from being laterally displaced by the guidance of the vertical groove portions 25*a* and 26*a*, and the elevation member 27*a* is prevented from being laterally displaced by the presence of the elevation member 27*a* in the depression 23. At this time, the support pins 24*a* and 24*b* are situated in the upper portions of the upper and lower inclined slots 35 and 36 of the elevation member 27*a*, respectively. The support pins 24*a* and 24*b* are situated in the vertical groove portions 25*a* and 26*a*, so the upper portion of the shutter 21 is tilted toward the air outlet 13 at a predetermined angle θ.

Figure 6:
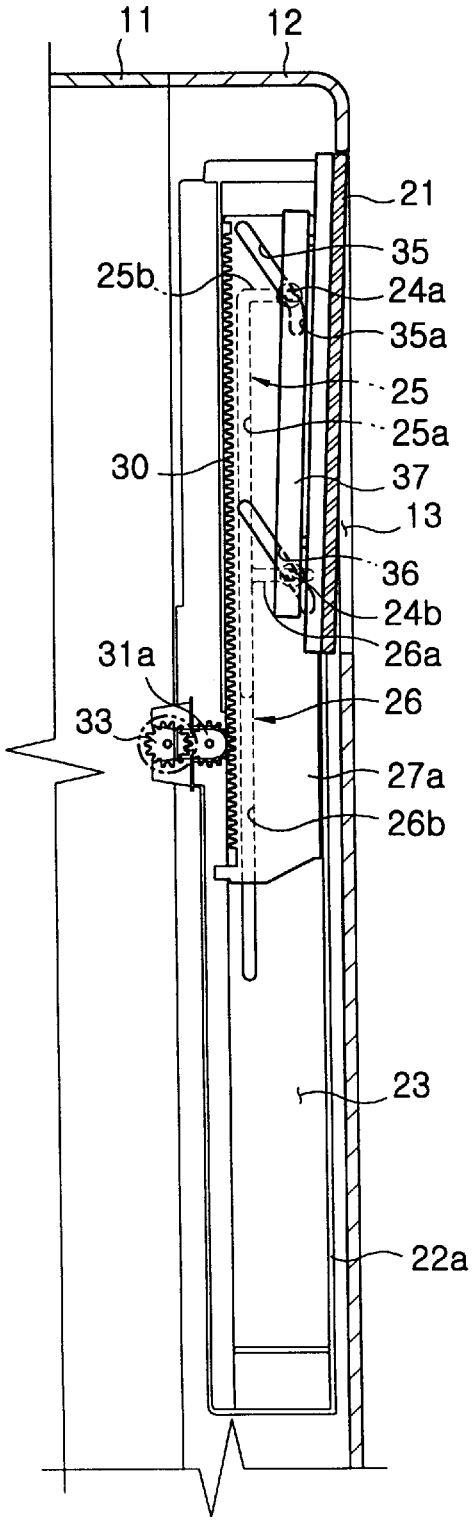

In this state, when the pinion gear 31 a engaged with the rack gear portion 30 of the elevation member 27*a* is rotated by the operation of the drive motor 32, the elevation member 27*a* is elevated, as illustrated in FIG. 6. At this time, the support pins 24*a* and 24*b* are elevated by the pushing of the elevation member 27*a*, and the shutter 21 secured to the support pins 24*a* and 24*b* is elevated at the same time. Thereafter, when the first and second support pins 24*a* and 24*b* reach the upper ends of the vertical groove portions 25*a* and 26*a* of the first and second guide grooves 25 and 26, the support pins 24*a* and 24*b* are not elevated any more, but are moved along the horizontal groove portions 25*b* and 26*b* of the first and second guide grooves 25 and 26.

If the elevation member 27*a* is elevated further when the first and second support pins 24*a* and 24*b* reach the upper ends of the vertical groove portions 25*a* and 26*a* of the first and second guide grooves 25 and 26, the support pins 24*a* and 24*b* are pushed by the upper and lower inclined slots 35 and 36 formed in the elevation member 27*a* and moved toward the air outlet 13 along the vertical groove portions 25*b* and 26*b* of the first and second guide grooves 25*a* and 26*a*. When the upper end of the elevation member 27*a* reaches the upper end of the depression 23, the support pins 24*a* and 24*b* are situated near to the air outlet 13 and in the lower portions of the upper and lower inclined slots 35 and 36.

Figure 7:
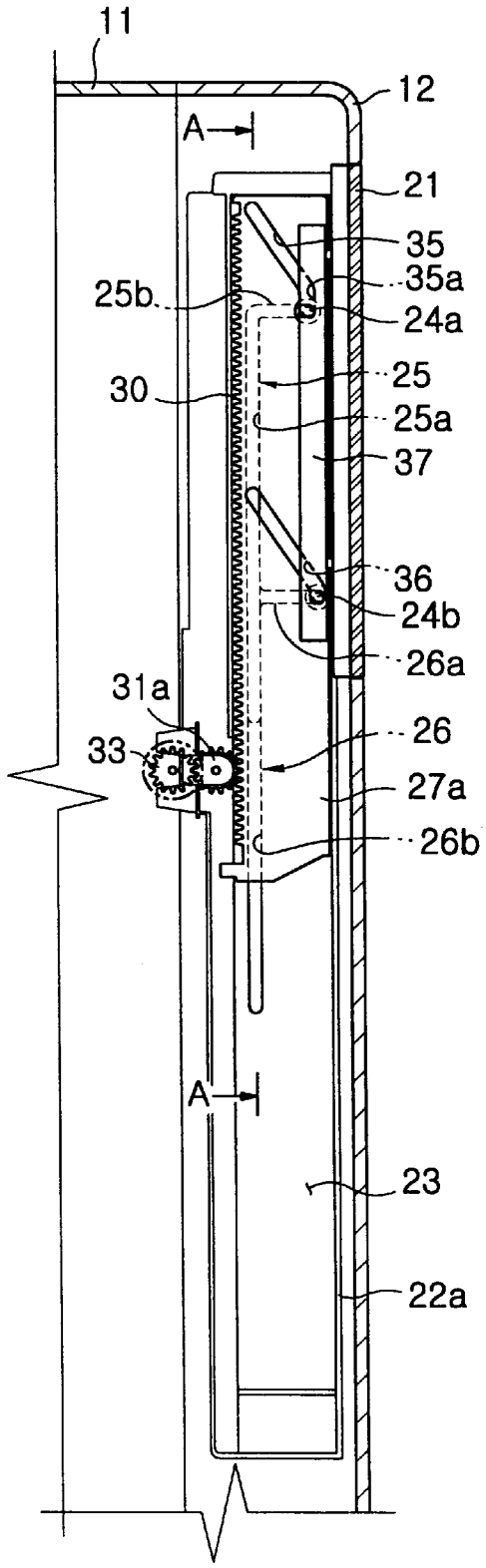

As shown in FIG. 6, if the elevation member 27*a* is elevated further when the first support pin 24*a* reaches the end of the vertical groove portion 25*b* of the upper guide groove 25, the first support pin 24*a* stops horizontal movement and, consequently, the horizontal movement of the upper portion of the shutter 21 is stopped. However, the first support pin 24*a* is guided into the vertical extension 35*a* and, thereby, the elevation member 27*a* is elevated further. At this time, the second support pin 24*b* is in the middle of the lower inclined slot 36, so the second support pin 24*b* can be horizontally moved further. As shown in FIG. 7, when the elevation member 27*a* is completely elevated, the lower end of the shutter 21 coincides with the lower end of the air outlet 13, thereby allowing the shutter 21 to be situated in the same plane that the front panel 12 forms. The lower portion of the shutter 21 is closed later than the upper portion of the shutter 21.

In order to open the closed shutter 21, the pinion gear 31*a* is rotated in the opposite direction by the operation of the drive motor 32, thus lowering the elevation member 27*a*. The support pins 24*a* and 24*b* are inwardly pushed by the two inclined slots 35 and 36 of the elevation member 27*a*, resulting in being opened while being moved to the interior of the air conditioner body 10 along the horizontal groove portions 25*b* and 26*b* of the guide grooves 25 and 26. In this case, the lower portion of the shutter 21 is first opened owing to difference between the upper and lower inclined grooves 35 and 36 and difference in the arrangement of the support pins 24*a* and 24*b*.

If the elevation member 27*a* is further lowered when the support pins 24*a* and 24*b* reach the vertical groove portions 25*a* and 26*a* of the guide grooves 25 and 26 and are situated in the upper portions of the inclined slots 35 and 36, the support pins 24*a* and 24*b* are lowered along the vertical groove portions 25*a* and 26*a* of the guide grooves 25 and 26, thereby causing the air outlet 13 of the front panel 12 to be completely opened. The opening of the shutter 21 is performed in the reverse manner of the closing of the shutter 21.

Meanwhile, during the opening and closing of the shutter 21, the first and second support pins 24*a* and 24*b* having different lengths are moved along the first and second guide grooves 25 and 26 having different depths, so the shutter 21 is smoothly elevated and lowered.

When the shutter 21 is closed or opened, the two pinion gears 31*a* and 31*b* are rotated at the same time because the gears 31*a* and 31*b* are connected by the common shaft 34. Subsequently, the two elevation members 27*a* and 27*b* are selectively elevated and lowered by the operation of the pinion gears 31*a* and 31*b* at the same time. Accordingly, since in the air outlet opening apparatus of the present invention the shutter 21 is selectively opened and closed by the simultaneous elevation and lowering of the two elevation members 27*a* and 27*b* mounted beside the shutter 21, the shutter 21 is selectively opened and closed smoothly and precisely.

As described above, the present invention provides an air outlet opening apparatus for air conditioners, which is capable of selectively elevating and lowering its shutter smoothly without the lateral tilt of the shutter because the shutter is selectively elevated and lowered by two elevation members mounted beside the shutter.

In addition, the elevation and lowering of the shutter are guided by the vertical groove portions formed on support plates and the opening and closing of the shutter are guided by the horizontal groove portions formed on the support plates and inclined slots formed in the elevation members, so the opening and closing of the shutter is performed precisely.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An air outlet opening apparatus for air conditioners, comprising:

a shutter for selectively opening and closing an air outlet formed on an air conditioner body;

a pair of support plates mounted beside said shutter to guide the elevation and lowering of said shutter; and elevation means for selectively elevating and lowering said shutter, with said elevation means including a pair of elevation members each positioned to be respectively slid on a corresponding one of said pair of support plates, a drive motor for generating power to move said pair of elevation members, and power transmission means for converting rotating movement of said drive motor to simultaneous movement of said pair of elevation members, and with said power transmission means including two rack gear portions each respectively formed on a corresponding one of said pair of elevation members, a pair of pinion gears, one of said pair of pinion gears for engaging with said drive motor, and each of said pair of pinion gears for respectively engaging with a corresponding one of said rack gear portions, and a common shaft for connecting said pair of pinion gears.

2. The air outlet opening apparatus according to claim 1, further comprised of said elevation means further includes a pair of guide grooves each respectively formed longitudinally on one of said pair of support plates and includes two pairs of support pins, each pair of said support pins for being respectively mounted in spaced relation on a corresponding opposing side of said shutter, and each pair of said support pins for being respectively inserted into a corresponding guide groove of said pair of guide grooves while passing through a corresponding one of said pair of elevation members.

3. The air outlet opening apparatus according to claim 2, further comprised of said pair of guide grooves each include a first guide groove and a second guide groove, and each of said pair of support pins includes a first support pin and a second support pin for respective insertion into said first guide groove and said second guide groove of a corresponding one of said pair of guide grooves.

4. The air outlet opening apparatus according to claim 3, further comprised of said first guide groove and said second guide groove are each formed with a different depth, and said first support pin and said second support pin are each formed with a length corresponding to a corresponding depth of said first guide groove and said second guide groove.

5. The air outlet opening apparatus according to claim 3, further comprised of said first guide groove being formed with a relatively narrow width and a relatively deep depth, said second guide groove being formed with a relatively wide width and a relatively shallow depth, and said first support pin and said second support pin each being formed with a width and a length corresponding to a width and a depth of a corresponding one of said first guide groove and said second guide groove.

6. The air outlet opening apparatus according to claim 4, further comprised of:

said first guide groove and said second guide groove each including at an upper end a vertical groove portion that is connected to a horizontal groove portion that extends toward said air outlet to respectively guide a corresponding one of said first support pin and said second support pin; and said pair of elevation members each include an upper inclined slot and a lower inclined slot, said upper inclined slot and said lower inclined slot to respectively guide a corresponding one of said first support pin and said second support pin through a corresponding said horizontal groove portion when said first support pin and said second support pin reach a corresponding said horizontal groove portion.

7. The air outlet opening apparatus according to claim 6, further comprised of:

said upper inclined slot includes a vertical extension at a lower end of said upper inclined slot and said lower inclined slot is formed to be longer than said upper inclined slot, and said first support pin when inserted into said upper inclined slot is positioned behind said second support pin when inserted into said lower inclined slot in an anteroposterior direction of said shutter.

8. The air outlet opening apparatus according to claim 1, further comprised of said common shaft being of a polygonal sectional shape to minimize twisting of said common shaft.

9. The air outlet opening apparatus according to claim 5, further comprised of:

said first guide groove and said second guide groove each including at an upper end a vertical groove portion that is connected to a horizontal groove portion that extends toward said air outlet to respectively guide a corresponding one of said first support pin and said second support pin; and said pair of elevation members each include an upper inclined slot and a lower inclined slot, said upper inclined slot and said lower inclined slot to respectively guide a corresponding one of said first support pin and said second support pin through a corresponding said horizontal groove portion when said first support pin and said second support pin reach a corresponding said horizontal groove portion.

10. The air outlet opening apparatus according claim 9, further comprised of:

said upper inclined slot includes a vertical extension at a lower end of said upper inclined slot and said lower inclined slot is formed to be longer than said upper inclined slot, and said first support pin when inserted into said upper inclined slot is positioned behind said second support pin when inserted into said lower inclined slot in an anteroposterior direction of said shutter.

11. The air outlet opening apparatus according claim 2, further comprised of said pair of guide grooves each include a first guide groove and a second guide groove, said first guide groove and said second guide groove partially overlap so as to be in a communicating relation, and each of said pair of support pins includes a first support pin and a second support pin for respective insertion into said first guide groove and said second guide groove of a corresponding one of said pair of guide grooves.

12. The air outlet opening apparatus according to claim 3, further comprised of:

said first guide groove and said second guide groove each including at an upper end a vertical groove portion that is connected to a horizontal groove portion that extends toward said air outlet to respectively guide a corresponding one of said first support pin and said second support pin; and said pair of elevation members each include an upper inclined slot and a lower inclined slot, said upper inclined slot and said lower inclined slot to respectively guide a corresponding one of said first support pin and said second support pin through a corresponding said horizontal groove portion when said first support pin and said second support pin reach a corresponding said horizontal groove portion.

13. The air outlet opening apparatus according claim 12, further comprised of:

said upper inclined slot includes a vertical extension at a lower end of said upper inclined slot and said lower inclined slot is formed to be longer than said upper inclined slot, and said first support pin when inserted into said upper inclined slot is positioned behind said second support pin when inserted into said lower inclined slot in an anteroposterior direction of said shutter.

* * * * *